US006394882B1

(12) United States Patent
Chen

(10) Patent No.: US 6,394,882 B1
(45) Date of Patent: May 28, 2002

(54) CMP METHOD AND SUBSTRATE CARRIER HEAD FOR POLISHING WITH IMPROVED UNIFORMITY

(75) Inventor: Chung-Zen Chen, Hsin-Chu (TW)

(73) Assignee: Vanguard International Semiconductor Corporation, Hsin-Chu (TW)

( * ) Notice: Subject to any disclaimer, the term of this patent is extended or adjusted under 35 U.S.C. 154(b) by 0 days.

(21) Appl. No.: 09/349,846

(22) Filed: Jul. 8, 1999

(51) Int. Cl.[7] ..... B24B 1/00
(52) U.S. Cl. ..... 451/41; 451/288; 451/398
(58) Field of Search ..... 451/41, 285, 286, 451/287, 288, 289, 398

(56) References Cited

U.S. PATENT DOCUMENTS 3,977,130 A * 8/1976 Degner ..... 51/131
5,297,364 A 3/1994 Tuttle
5,421,769 A 6/1995 Schultz et al.
5,599,423 A 2/1997 Parker et al.
5,643,053 A 7/1997 Shendon
5,643,061 A 7/1997 Jackson et al.
5,961,375 A * 10/1999 Nagahara et al. ..... 451/41

OTHER PUBLICATIONS

Chang et al., "ULSI Technology", The McGraw Hill Companies, Inc., New York, 1996, pp. 439–442.

* cited by examiner

*Primary Examiner*—Timothy V. Eley
*Assistant Examiner*—Dung Van Nguyen
(74) *Attorney, Agent, or Firm*—George O. Saile; Stephen B. Ackerman

(57) ABSTRACT

An improved and new substrate carrier head for use in a CMP apparatus is described. The new substrate carrier head permits simple adjustment of the local pressure between the polishing pad and the substrate across a diameter of the substrate and thereby allows adjustment of the polish removal rate across the diameter of the substrate. The substrate carrier head comprises a flexible carrier plate and a plurality of nested concentric cylinders placed on the flexible carrier plate to exert pressure between the flexible carrier plate and the polishing pad. The distribution of local pressure is adjusted by changing the height and density of the individual cylinders. The result is improved polish removal rate uniformity during CMP.

18 Claims, 3 Drawing Sheets

CM P METHOD AND SUBSTRATE CARRIER HEAD FOR POLISHING WITH IMPROVED UNIFORMITY

BACKGROUND OF THE INVENTION (1) Field of the Invention

This invention relates to an apparatus and method for CMP (Chemical Mechanical Polishing) of a semiconductor substrate and more specifically to an improved CMP apparatus and method of CMP which results in improved polishing uniformity by varying the loading pressure of the substrate against the polishing pad.

(2) Description of Related Art

In the fabrication of semiconductor integrated circuits CMP (Chemical Mechanical Polishing) has been developed for providing smooth topographies on surfaces deposited on the semiconductor substrates. Rough topography results when metal conductor lines are formed over a substrate containing device circuitry. The metal conductor lines serve to interconnect discrete devices, and thus form integrated circuits. The metal conductor lines are further insulated from-the next interconnection level by thin layers of insulating material and holes formed through the insulating layers provide electrical access between successive conductive interconnection layers. In such wiring processes, it is desirable that the insulating layers have a smooth surface topography, since it is difficult to lithographically image and pattern layers applied to rough surfaces. CMP can, also, be used to remove different layers of material from the surface of a semiconductor substrate. For example, following via hole formation in an insulating material layer, a metallization layer is blanket deposited and then CMP is used to produce planar metal studs embedded in the insulating material layer.

Briefly, the CMP processes involve holding and rotating a thin, flat substrate of the semiconductor material against a wetted polishing surface under controlled chemical, pressure and temperature conditions. A chemical slurry containing a polishing agent, such as alumina or silica, is used as the abrasive material. Additionally, the chemical slurry contains selected chemicals which etch various surfaces of the substrate during processing. The combination of mechanical and chemical removal of material during polishing results in superior planarization of the polished surface.

An important challenge in CMP is to achieve uniform polishing across the semiconductor substrate and uniform thickness removal across the semiconductor substrate.

C. Y. Chang, S. M. Sez, in ULSI Technology, The McGrawHill Company, Inc., 1997, pp 439–442, discuss CMP techniques and CMP removal rates as a function of pressure and velocity of individual points on the wafer substrate. On p. 441, it is stated that the edge of a wafer substrate has a polishing rate equal to or higher than the center of the wafer. To compensate for this, the equipment uses a slightly convex curvature on the wafer carrier to exert a higher pressure toward the center of the wafer.

U.S. Pat. No. 5,643,053 entitled "Chemical Mechanical Polishing Apparatus With Improved Polishing Control" granted Jul. 1, 1997 to Norm Shendon describes a CMP apparatus and substrate carrier which controls the load force of the substrate against the polishing pad.

U.S. Pat. No. 5,643,061 entitled "Pneumatic Polishing Head For CMP Apparatus" granted Jul. 1, 1997 to Paul David Jackson shows a CMP wafer carrier in which the carrier plate is thicker in the center than at the side wall in order to prevent the carrier plate from flexing when a pressure differential exists across the bottom plate.

U.S. Pat. No. 5,421,769 entitled "Apparatus For Planarizing Semiconductor Wafers, And A Polishing Pad For A Planarization Apparatus" granted Jun. 6, 1995 to Laurence D. Schultz et al describes a CMP method in which a non-circular polishing pad is used to improve polishing uniformity.

U.S. Pat. No. 5,297,364 entitled "Polishing Pad With Controlled Abrasion Rate" granted Mar. 29, 1994 to Mark E. Tuttle shows a polishing pad with a face shaped to produce controlled non-uniform CMP rates.

U.S. Pat. No. 5,599,423 entitled "Apparatus And Method For Simulating And Optimizing A Chemical Mechanical Polishing System" granted Feb. 4, 1997 to Norman W. Parker et al shows a CMP apparatus used to simulate CMP processes and study CMP variables, such as polishing uniformity.

The present invention is directed to a novel CMP apparatus and CMP method which achieve uniform polishing across the semiconductor substrate and uniform thickness removal across the semiconductor substrate.

SUMMARY OF THE INVENTION

It is a general object of the present invention to provide an improved and new apparatus and method for achieving uniform polishing and uniform thickness removal across a semiconductor substrate.

A more specific object of the present invention is to provide an improved CMP apparatus and method for achieving uniform polishing and uniform thickness removal across a semiconductor substrate, in which the pressure between the polishing pad and the semiconductor substrate is adjusted to produce uniform material removal.

Another object of the present invention is to provide an improved CMP apparatus method for achieving uniform polishing and uniform thickness removal across a semiconductor substrate, whereby the method of adjusting the local pressure between the polishing pad and the semiconductor substrate is simple and of low cost.

In accordance with the present invention, the above and other objectives are realized by a substrate carrier head for chemical mechanical polishing, comprising: a flexible carrier plate to hold the substrate against a polishing pad, said flexible carrier plate being connectable to a drive shaft to rotate with said drive shaft; and a plurality of nested concentric cylinders placed on said flexible carrier plate to exert pressure between said flexible carrier plate and said polishing pad.

In another embodiment of the present invention, the above and other objectives are realized by using a chemical mechanical polishing method for removal of material from the surface of a substrate, the uniformity of removal of material being improved through the steps of: providing a polishing pad affixed to a rotatable polishing platen; providing a rotatable and flexible carrier plate to hold said substrate against said polishing pad; providing a plurality of nested concentric cylinders placed on said flexible carrier plate to exert pressure between said flexible carrier plate and said polishing pad; dispensing a polishing slurry onto said rotatable polishing pad; providing a first means to rotate said flexible carrier plate; and providing a second means to rotate said polishing platen.

BRIEF DESCRIPTION OF THE DRAWINGS

The object and other advantages of this invention are best described in the preferred embodiments with reference to the attached drawings that include.

DESCRIPTION OF THE PREFERRED EMBODIMENTS

The new and improved CMP apparatus and method for achieving uniform polishing and uniform thickness removal across a semiconductor substrate, in which the pressure between the polishing pad and the semiconductor substrate is adjusted to produce uniform material removal will now be described in detail.

Figure 1:
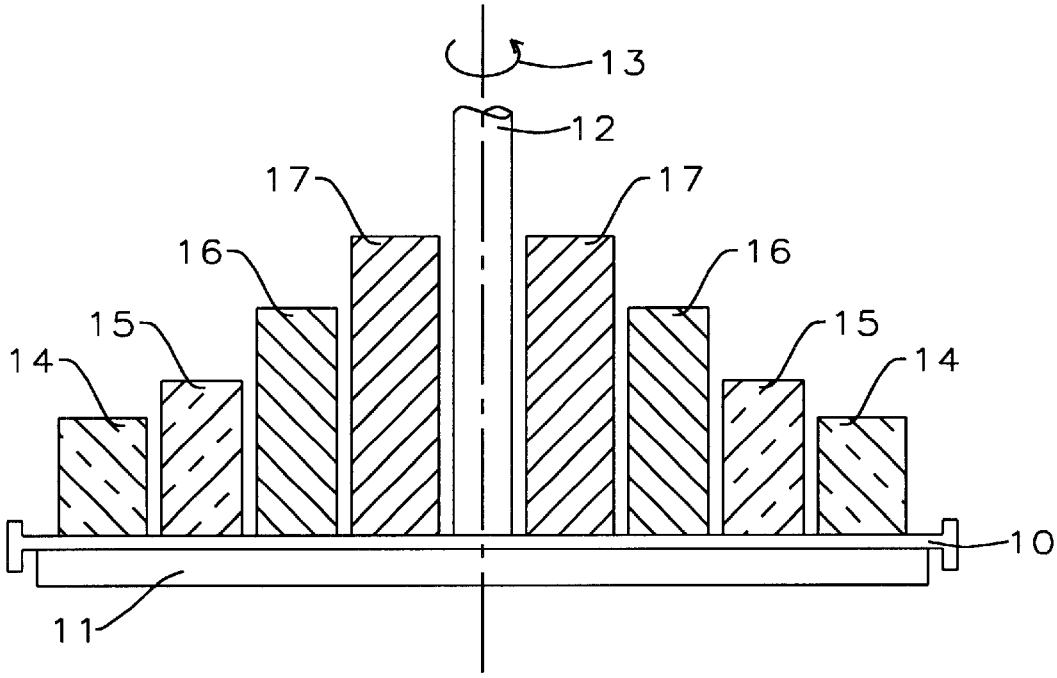
FIG. 1, which in cross-sectional representation illustrates a CMP carrier head for one embodiment of the present invention.

Referring to FIG. 1, which in cross-sectional representation illustrates a CMP substrate carrier head of one embodiment of the present invention, a flexible carrier plate 10 holds the substrate 11 against a conventional polishing pad (not shown). The flexible carrier plate 10 has a diameter approximately equal to the diameter of the substrate to be polished and is attached to a drive shaft 12, which is rotatable, as shown by arrow 13. It is important that the carrier plate 10 be flexible in order to distribute a range of applied pressures across the diameter of the substrate. Sufficient flexibility is obtained if the thickness of the carrier plate 10 is between about 0.010 and 0.10 inch. The preferred thickness of the flexible carrier plate 10 is 0.02 inch when the carrier plate 10 is constructed of stainless steel. A plurality of nested concentric cylinders 14–17, placed on the flexible carrier plate 10, exert pressure between the flexible carrier plate 10 and the substrate 11 and the polishing pad (not shown). The plurality of nested concentric cylinders comprises at least one cylinder, having a diameter less than the diameter of the substrate carrier head, but may comprise between about 1 and 10 cylinders. The number of concentric cylinders is determined by the range of pressures required across the diameter of the substrate to obtain the desired uniformity of chemical mechanical polishing. Each cylinder exerts a pressure on the flexible carrier plate 10 independent of the other cylinders. The pressure exerted by each cylinder is applied to the area of the flexible carrier plate in contact with that cylinder and that pressure is transmitted to the substrate in contact with flexible carrier plate. The height and density of each individual cylinder in the plurality of nested concentric cylinders determine the localized pressure between the flexible carrier plate and the polishing pad in the area where each cylinder contacts the flexible carrier plate. In fact, the localized pressure between the flexible carrier plate and the polishing pad is directly dependent on the height and density of each cylinder. Therefore, the localized pressure exerted between the flexible carrier plate and the polishing pad can be increased by increasing the height of the cylinder or by constructing the cylinder of a material having a larger density. For example, a 12 inch high cylinder constructed from a material with density, 8 grams/cm$^3$, exerts a pressure of about 3.5 psi on the area of contact between the cylinder and the flexible carrier plate. As illustrated in FIG. 1, the nested concentric cylinders 14–17, are placed so that the tallest cylinder 17 is near the center of flexible carrier plate and the shortest cylinder 14 is near the outer edge of the flexible carrier plate. This arrangement produces a greater pressure between the substrate 11 and the polishing pad (not shown) at the center of the substrate than at the outer edge of the substrate and thereby increases the polish removal rate at the center of the substrate. Increasing the polish removal rate near the center of the substrate by this method can compensate for the normally larger polish removal rate found at the edge of the substrate and thus produce greater uniformity in the polish removal rate across the substrate.

Figure 2:
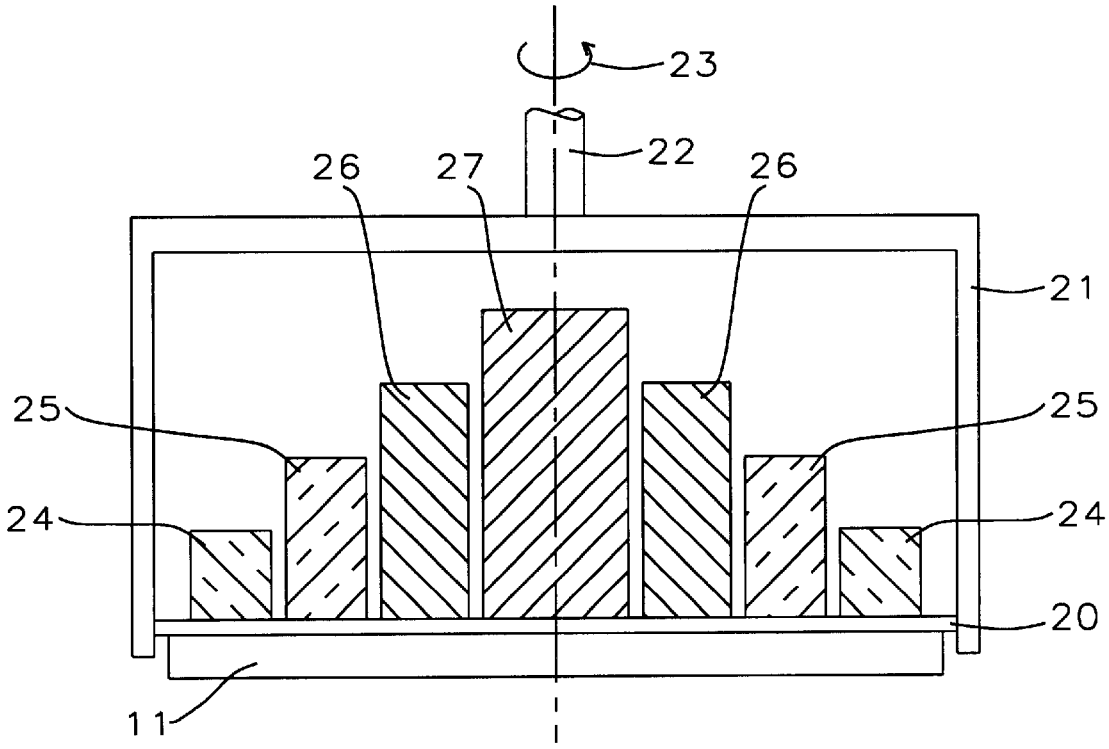
FIG. 2, which in cross-sectional representation illustrates a CMP carrier head for a second embodiment of the present invention.

A second embodiment of the present invention is illustrated in FIG. 2. The CMP substrate carrier head comprises a flexible carrier plate 20 which holds substrate 11 against a conventional polishing pad (not shown). The flexible carrier plate 20 has a diameter approximately equal to the diameter of the substrate to be polished and is attached to a housing 21 and drive shaft 22, which is rotatable, as shown by arrow 23. It is important that the carrier plate 20 be flexible in order to distribute a range of applied pressures across the diameter of the substrate. Sufficient flexibility is obtained if the thickness of the carrier plate 20 is between about 0.01 and 0.10 inch. The preferred thickness of the flexible carrier plate 20 is 0.2 inch when the carrier plate 20 is constructed of stainless steel. A plurality of nested concentric cylinders 24–27, placed on the flexible carrier plate 20, exert pressure between the flexible carrier plate 20 and the substrate 11 and the polishing pad (not shown). The plurality of nested concentric cylinders comprises at least one cylinder, having a diameter less than the diameter of the substrate carrier head, but may comprise between about 1 and 10 cylinders. The number of concentric cylinders is determined by the range of pressures required across the diameter of the substrate to obtain acceptable uniformity of chemical mechanical polishing. Each cylinder exerts a pressure on the flexible carrier plate 20 independent of the other cylinders. The pressure exerted by each cylinder is applied to the area of the flexible carrier plate in contact with that cylinder and that pressure is transmitted to the substrate in contact with the flexible carrier plate. The height and density of each individual cylinder in the plurality of nested concentric cylinders determine the localized pressure between the flexible carrier plate and the polishing pad in the area where each cylinder contacts the flexible carrier plate. In fact, the localized pressure between the flexible carrier plate and the polishing pad is directly dependent on the height and density of each cylinder. Therefore, the localized pressure exerted between the flexible carrier plate and the polishing pad can be increased by increasing the height of the cylinder or by constructing the cylinder of a material having a larger density. For example, a 12 inch high cylinder constructed from a material with density, 8 grams/cm$^3$, exerts a pressure of about 3.5 psi on the area of contact between the cylinder and the flexible carrier plate. As illustrated in FIG. 2, the nested concentric cylinders 24–27, are placed so that the tallest cylinder 27 is near the center of flexible carrier plate and the shortest cylinder 24 is near the outer edge of the flexible carrier plate. This arrangement produces a greater pressure between the substrate 11 and the polishing pad (not shown) at the center of the substrate than at the outer edge of the substrate and thereby increases the polish removal rate at the center of the substrate. Increasing the polish removal rate near the center of the substrate by this method compensates for the normally larger polish removal rate found at the edge of the substrate and thus produces greater uniformity in the polish removal rate across the substrate.

Figure 3:
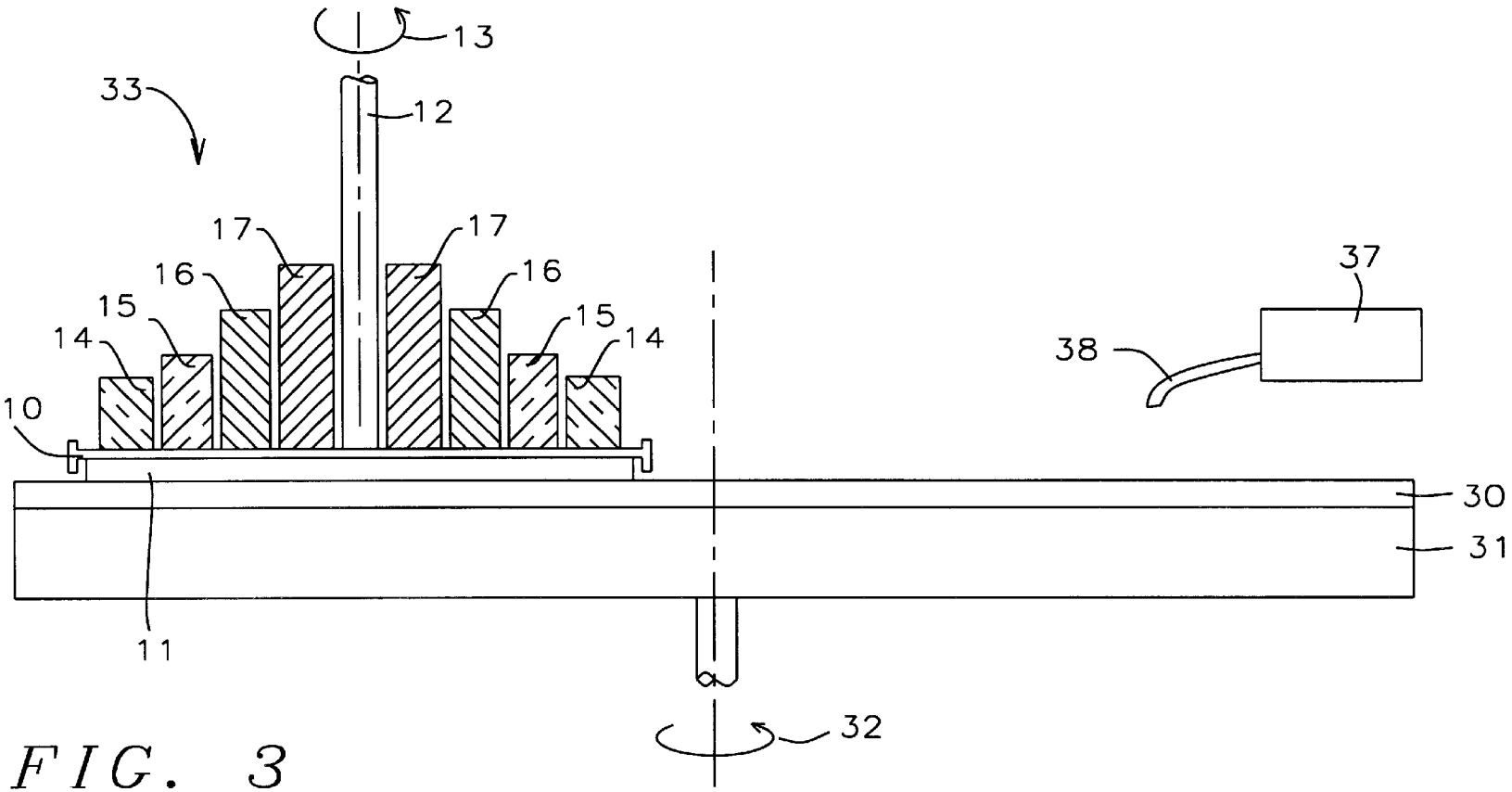
FIG. 3, which in cross-sectional representation illustrates a CMP apparatus which uses one embodiment of the CMP substrate carrier head of the present invention.

The CMP substrate carrier heads illustrated in FIGS. 1 and 2 are used in a CMP apparatus to achieve greater uniformity in polish removal rates across the substrate. For example, FIG. 3, in cross-sectional representation, illustrates the use of the CMP substrate carrier head shown in FIG. 1 in a CMP apparatus. Polishing pad 30 is affixed to a rotatable polishing platen 31. A means is provided to rotate the polishing platen 31 and polishing pad 30, as shown by arrow 32. The rotatable CMP substrate carrier head 33 holds substrate 11 against polishing pad 30. The rotatable CMP substrate carrier 33 comprises a flexible carrier plate 10 which holds the substrate 11 against polishing pad 30. The flexible carrier plate 10 has a diameter approximately equal to the diameter of the substrate to be polished and is attached to a drive shaft 12, which is rotatable, as shown by arrow 13. A plurality of nested concentric cylinders 14–17, placed on the flexible carrier plate 10, exert pressure between the flexible carrier plate 10 and the substrate 11 and the polishing pad 30. The plurality of nested concentric cylinders comprises at least one cylinder, having a diameter less than the diameter of the substrate carrier head, but may comprise between about 1 and 10 cylinders. The number of concentric cylinders is determined by the range of pressures required across the diameter of the substrate to obtain maximum uniformity of chemical mechanical polishing. Each cylinder exerts a pressure on the flexible carrier plate 10 independent of the other cylinders. The pressure exerted by each cylinder is applied to the area of the flexible carrier plate in contact with that cylinder and that pressure is transmitted to the substrate in contact with flexible carrier plate. The height and density of each individual cylinder in the plurality of nested concentric cylinders determine the localized pressure between the flexible carrier plate and the polishing pad in the area where each cylinder contacts the flexible carrier plate. As illustrated in FIG. 3, the nested concentric cylinders 14–17, are placed so that the tallest cylinder 17 is near the center of flexible carrier plate and the shortest cylinder 14 is near the outer edge of the flexible carrier plate. This arrangement produces a greater pressure between the substrate 11 and the polishing pad 30 at the center of the substrate than at the outer edge of the substrate and thereby increases the polish removal rate at the center of the substrate. A polishing slurry comprising silica or alumina and polishing chemicals and $H_2O$ at a pH between about pH=9 and pH=14 is dispensed from reservoir 37 through conduit 38 onto polishing pad 30. Polishing platen 31 and polishing pad 30 are rotated at a speed between about 10 and 100 rpm. CMP substrate carrier head 33 is rotated, as indicated by arrow 13, at a speed between about 10 and 100 rpm. Increasing the polish removal rate near the center of the substrate by this method compensates for the normally larger polish removal rate found at the edge of the substrate and thus produces greater uniformity in the polish removal rate across the substrate.

Figure 4:
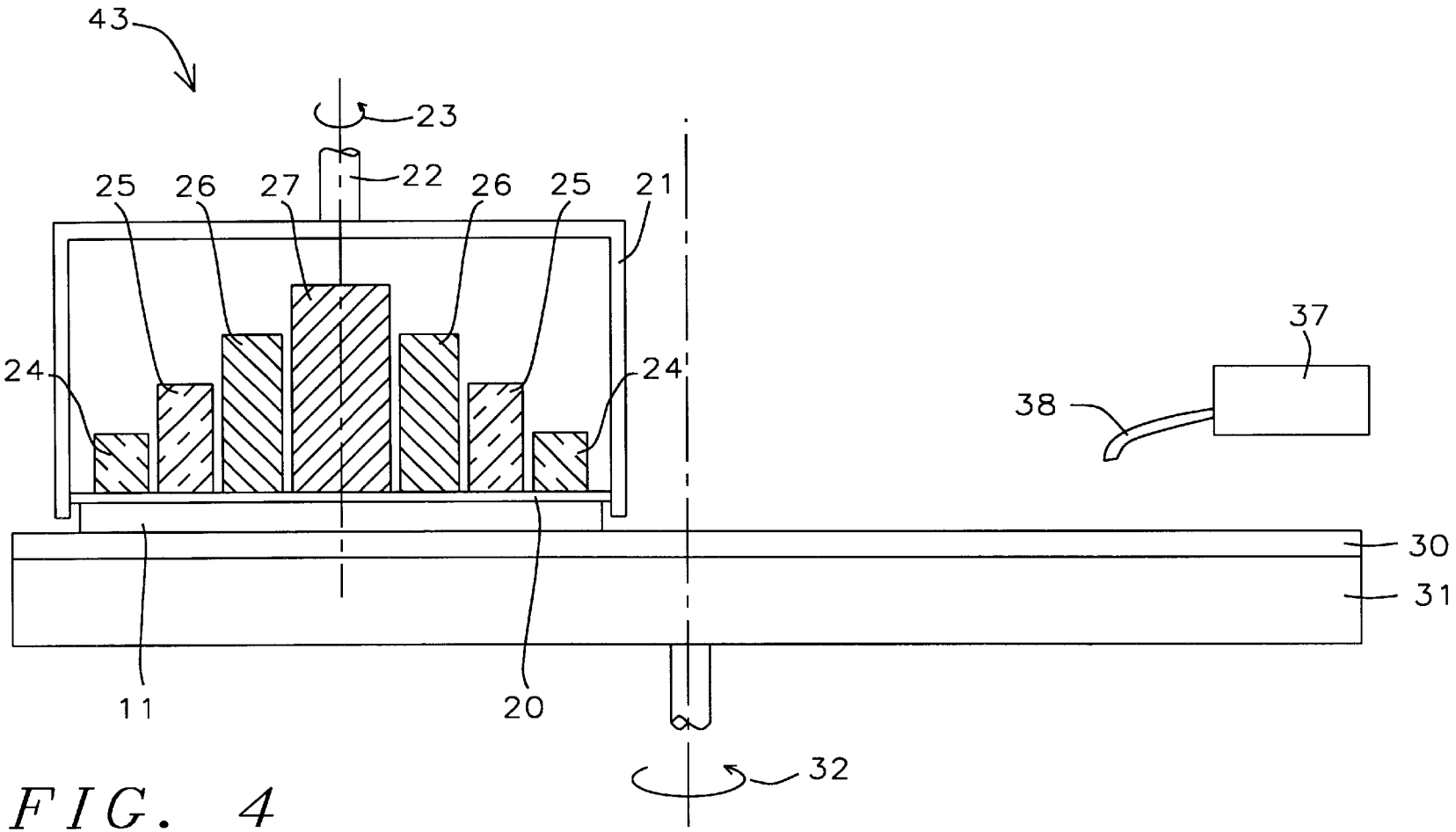
FIG. 4, which in cross-sectional representation illustrates a CMP apparatus which uses a second embodiment of the CMP substrate carrier head of the present invention.

FIG. 4, in cross-sectional representation, illustrates the use of the CMP substrate carrier head shown in FIG. 2 in a CMP apparatus. Polishing pad 30 is affixed to a rotatable polishing platen 31. A means is provided to rotate the polishing platen 31 and polishing pad 30, as shown by arrow 32. The rotatable CMP substrate carrier 43 comprises a flexible carrier plate 20 which holds substrate 11 against the polishing pad 30. The flexible carrier plate 20 has a diameter approximately equal to the diameter of the substrate to be polished and is attached to a housing 21 and drive shaft 22, which is rotatable, as shown by arrow 23. A plurality of nested concentric cylinders 24–27, placed on the flexible carrier plate 20, exert pressure between the flexible carrier plate 20 and the substrate 11 and the polishing pad 30. The plurality of nested concentric cylinders comprises at least one cylinder, having a diameter less than the diameter of the substrate carrier head, but may comprise between about 1 and 10 cylinders. The number of concentric cylinders is determined by the range of pressures required across the diameter of the substrate to obtain maximum uniformity of chemical mechanical polishing. Each cylinder exerts a pressure on the flexible carrier plate 20 independent of the other cylinders. The pressure exerted by each cylinder is applied to the area of the flexible carrier plate in contact with that cylinder and that pressure is transmitted to the substrate in contact with the flexible carrier plate. The height and density of each individual cylinder in the plurality of nested concentric cylinders determine the localized pressure between the flexible carrier plate and the polishing pad in the area where each cylinder contacts the flexible carrier plate. As illustrated in FIG. 4, the nested concentric cylinders 24–27, are placed so that the tallest cylinder 27 is near the center of flexible carrier plate and the shortest cylinder 24 is near the outer edge of the flexible carrier plate. This arrangement produces a greater pressure between the substrate 11 and the polishing pad 30 at the center of the substrate than at the outer edge of the substrate and thereby increases the polish removal rate at the center of the substrate. A polishing slurry comprising silica or alumina and polishing chemicals and $H_2O$ at a pH between about pH=9 and pH=14 is dispensed from reservoir 37 through conduit 38 onto polishing pad 30. Polishing platen 31 and polishing pad 30 are rotated at a speed between about 10 and 100 rpm. CMP substrate carrier head 43 is rotated, as indicated by arrow 23, at a speed between about 10 and 100 rpm. Increasing the polish removal rate by this method can compensate for the normally larger polish removal rate found at the edge of the substrate and thus produce greater uniformity in the polish removal rate across the substrate.

While the invention has been particularly shown and described with reference to the preferred embodiments thereof, it will be understood by those skilled in the art that various changes in form and details may be made without departing from the spirit and scope of the invention.

What is claimed is:

1. A substrate carrier head for chemical mechanical polishing a substrate, comprising:

a flexible carrier plate to hold said substrate against a polishing pad, said flexible carrier plate being connectable to a drive shaft to rotate with said drive shaft; and a plurality of nested concentric cylinders placed on said flexible carrier plate, wherein the height of each individual cylinder and the mass density of each individual cylinder in said plurality of nested concentric cylinders combine to exert pressure between said flexible carrier plate and said polishing pad in the area where each individual cylinder contacts said flexible carrier plate.

2. The substrate carrier head of claim 1, wherein said flexible carrier plate has a thickness between about 0.01 and 0.10 inch.

3. The substrate carrier head of claim 1, wherein said flexible carrier plate has a preferred thickness of about 0.02 inch.

4. The substrate carrier head of claim 1, wherein said plurality of nested concentric cylinders comprises at least one cylinder, having a diameter less than the diameter of the substrate carrier head.

5. The substrate carrier of claim 4, wherein a height and a mass density of said at least one cylinder determine the pressure between said flexible carrier plate and said polishing pad in the area where said at least one cylinder contacts said flexible carrier plate.

6. The substrate carrier head of claim 1, wherein said plurality of nested concentric cylinders comprises between about 1 and 10 cylinders.

7. The substrate carrier of claim 6, wherein a height and a mass density of each individual cylinder in the plurality of nested concentric cylinders determine the localized pressure between said flexible carrier plate and said polishing pad in the area where each individual cylinder contacts said flexible carrier plate.

8. The substrate carrier of claim 7, wherein the height of each individual cylinder in the plurality of nested concentric cylinders is selected in order to provide a desired distribution of different pressures between said flexible carrier plate and said polishing pad, said desired distribution of different pressures being applied across the diameter of the flexible carrier plate.

9. The substrate carrier of claim 7, wherein the mass density of each individual cylinder in the plurality of nested concentric cylinders is selected in order to provide a desired distribution of different pressures between said flexible carrier plate and said polishing pad, said desired distribution of different pressures being applied across the diameter of the flexible carrier plate.

10. A chemical mechanical polishing method for removal of material from a substrate, in which the uniformity of removal of material is improved through the steps of:

providing a polishing pad affixed to a rotatable polishing platen;

providing a rotatable and flexible carrier plate to hold said substrate against said polishing pad;

providing a plurality of nested concentric cylinders placed on said flexible carrier plate, wherein the height of each individual cylinder and the mass density of each individual cylinder in said plurality of nested concentric cylinders combine to exert pressure between said flexible carrier plate and said polishing pad in the area where each individual cylinder contacts said flexible carrier plate;

dispensing a polishing slurry onto said rotatable polishing pad;

providing a first means to rotate said flexible carrier plate; and providing a second means to rotate said polishing platen.

11. The method of claim 10, wherein said rotatable and flexible carrier plate has a thickness between about 0.01 and 0.10 inch.

12. The method of claim 10, wherein said rotatable and flexible carrier plate has a preferred thickness of about 0.02 inch.

13. The method of claim 10, wherein said plurality of nested concentric cylinders comprises at least one cylinder, having a diameter less than the diameter of the substrate carrier head.

14. The method of claim 13, wherein a height and a mass density of said at least one cylinder determine the pressure between said flexible carrier plate and said polishing pad in the area where said at least one cylinder contacts said flexible carrier plate.

15. The method of claim 10, wherein said plurality of nested concentric cylinders comprises between about 1 and 10 cylinders.

16. The method of claim 15, wherein a height and a mass density of each individual cylinder in the plurality of nested concentric cylinders determine the localized pressure between said flexible carrier plate and said polishing pad in the area where each individual cylinder contacts said flexible carrier plate.

17. The method of claim 16, wherein the height of each individual cylinder in the plurality of nested concentric cylinders is selected in order to provide a desired distribution of different pressures between said flexible carrier plate and said polishing pad, said desired distribution of different pressures being applied across the diameter of the flexible carrier plate.

18. The method of claim 16, wherein the mass density of each individual cylinder in the plurality of nested concentric cylinders is selected in order to provide a desired distribution of different pressures between said flexible carrier plate and said polishing pad, said desired distribution of different pressures being applied across the diameter of the flexible carrier plate.

* * * * *